United States Patent [19]

Smith

[11] 4,110,720

[45] Aug. 29, 1978

[54] THERMOSTATIC CONTROL

[75] Inventor: Charles R. Smith, West Allis, Wis.

[73] Assignee: Cutler-Hammer, Inc., Milwaukee, Wis.

[21] Appl. No.: 753,416

[22] Filed: Dec. 22, 1976

[51] Int. Cl.[2] ..... H01H 37/22

[52] U.S. Cl. ..... 337/319; 200/83 WM; 337/317

[58] Field of Search ..... 337/319, 318, 317, 320, 337/313, 345, 346, 347, 57, 368; 200/83 WM

[56] References Cited

U.S. PATENT DOCUMENTS 3,135,849 6/1964 Kuhn et al. ..... 337/319

FOREIGN PATENT DOCUMENTS 1,809,964 1/1970 Fed. Rep. of Germany .... 200/83 WM

*Primary Examiner*—Harold Broome

*Attorney, Agent, or Firm*—Michael, Best & Friedrich

[57] ABSTRACT

A thermostatic control as shown and claimed in U.S. Pat. No. 3,135,849 in which the reed in this new disclosure has a pair of split legs. One leg of a first set of such pair is a flipper leg and the other leg of such first set carries a contact which is designed to be resistant to erosion from arcing and welding. One leg of another set of such pair of legs carries a contact which is designed to carry current in excess of 20 amp. at 250 V, the other leg of said other set is a flipper leg. A lost motion slot in a flipper spring provides a sequential drive for the two contacts carrying legs such that the arc resisting contact both makes and breaks the electrical circuit and the current carrying contact never makes or breaks the circuit but merely carries the current established by the arc resisting contact.

The control as shown also eliminates a force multiplying adjusting lever and a pivot interface between such lever and the range lever. Reducing the force multiplying and adjusting levers from 2 to 1 improves stability because of the non split stabilizing spring and reduces cost.

4 Claims, 9 Drawing Figures

THERMOSTATIC CONTROL

BRIEF SUMMARY OF THE INVENTION (1) Field of the Invention

This invention relates to toggle controlled snap action switch type of thermostatic controls. An object of the invention is to provide thermostatic control which is adapted to handle in excess of 20 amperes at 250 volts, and have improved stability and reduce cost.

(2) Description of the Prior Art

Thermostats of toggle controlled snap action switch type are described in U.s. Pat. Nos. 2,314,191; 2,314,240; 3,135,849; 3,194,933; 3,241,381 and 3,407,277. The thermostats described in such patents include a thermal responsive power element operating in response to changes in vapor brought about by changes in temperature. However, none of these patents teaches a thermostatic control in which one set of contacts never makes or breaks any electrical circuit, while another set of contacts both makes and breaks such electrical circuit. None of these patents teaches the elimination of a force multiplying and adjusting lever and pivot interface between such lever and an adjustable range lever.

Figure 1:
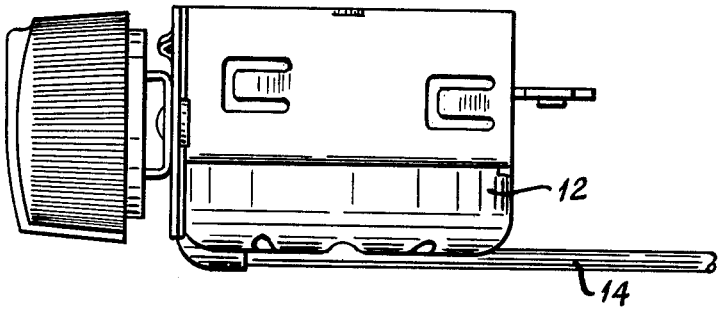
FIG. 1 is a view in side elevation of a thermostatic control constructed in accordance with the present invention.
Figure 2:
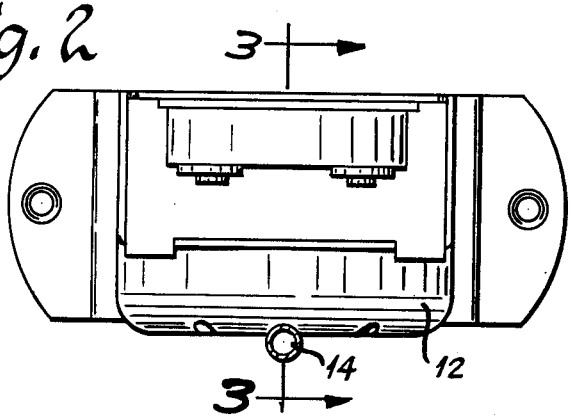
FIG. 2 is a right end view of the control shown in FIG. 1.
Figure 3:
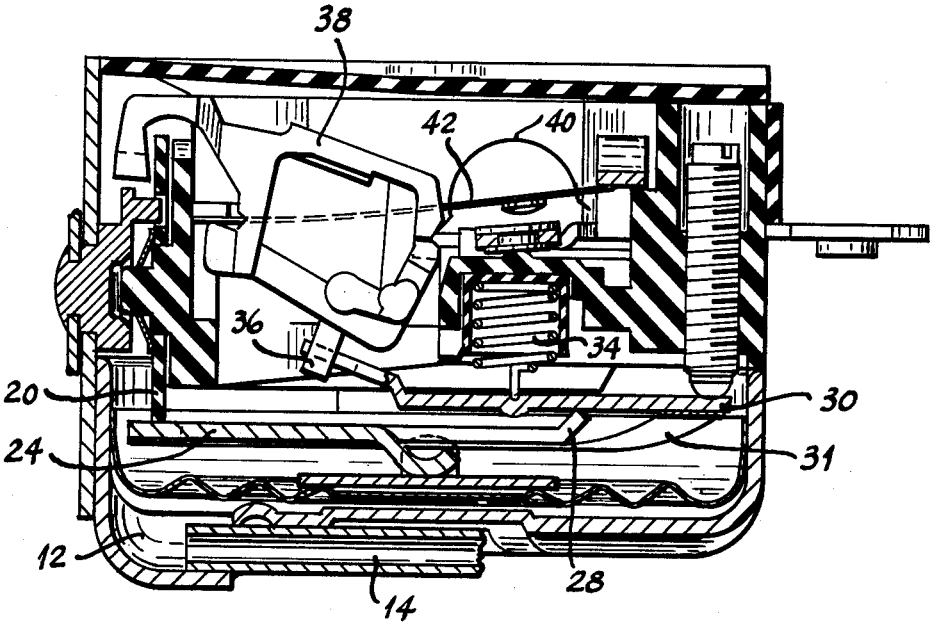
FIG. 3 is a sectional view taken on the line 3—3 of FIG. 2.
Figure 4:
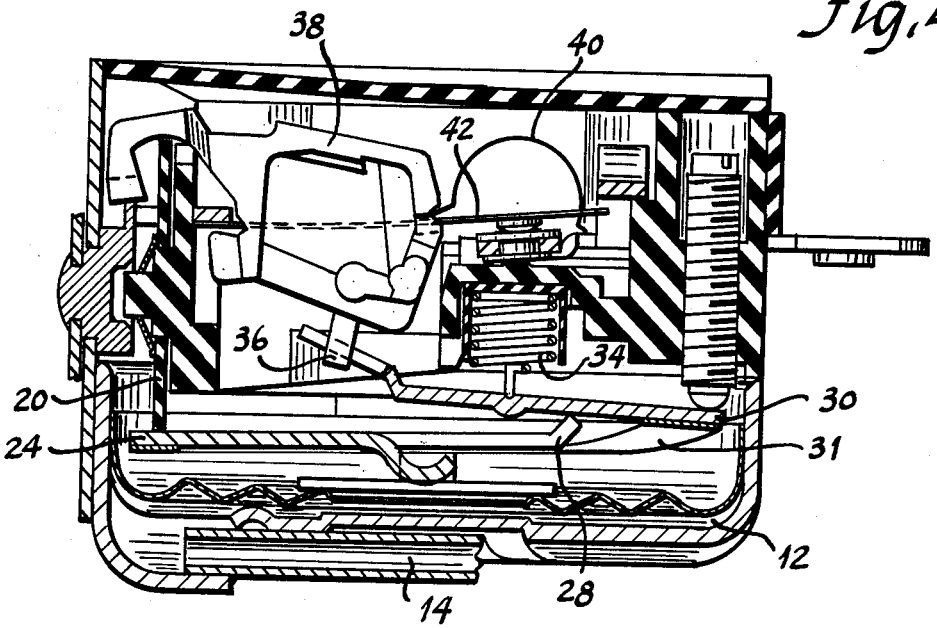
FIG. 4 is a sectional view like FIG. 3 showing the control in another operating condition.
Figure 5:
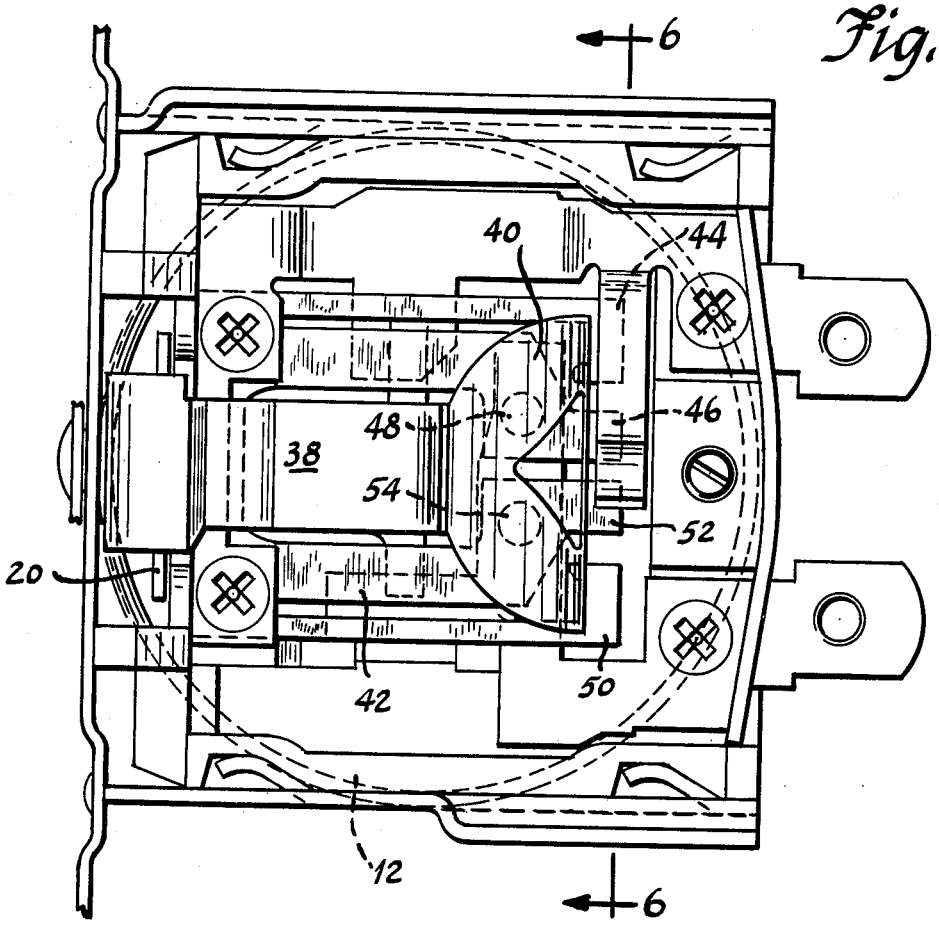
FIG. 5 is a top plan view of the control with the cover removed to show the relationship of the interior mechanism.
Figure 6:
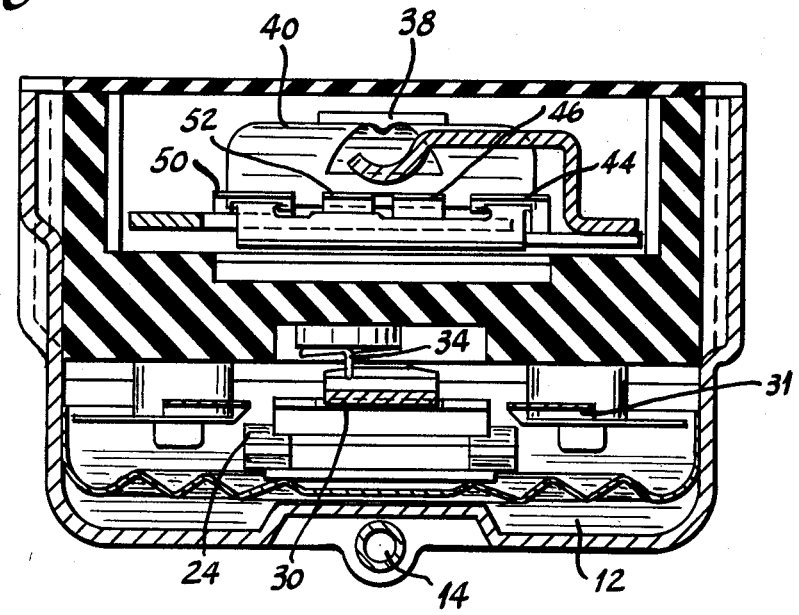
FIG. 6 is a view in cross section taken along the line 6—6 of FIG. 5.
Figure 7:
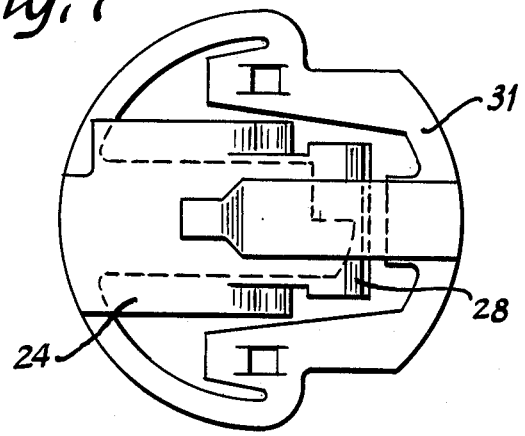
FIG. 7 is a top plan view of the stabilizing member.

The structure and function of the basic components shown and described in U.S. Pat. No. 3,135,849 are incorporated herein by reference and are not described except as modified and described hereinafter. Such basic components include: (1) a calibrated thermo-responsive power element 12 with a capillary tube 14 which element and tube are charged in the customary manner with a vapor pressure forming gas such as Freon F-22 or F-12 or methyl chloride all in accordance with the teachings of Kuhn et al U.S. Pat. No. 3,135,849 (See Col. 3 lines 9–14); (2) a range adjusting cam 20; (3) a flexible stabilizing leaf member 31; (4) a range lever 24; (5) a biasing spring 34 and a toggle mechanism 38 including a snap action switch.

Cut-in lever 70 of said patent is omitted, and instead a driving lever 30 is directly engaged by the outer end 28 of the range lever 24. Such driving lever is engaged with the toggle mechanism 38 by a connection 36 with minimal lost motion to operate the toggle mechanism and the snap switch. Control of any differential required, can be accurately accomplished by factory manufacturing procedures. This eliminates one lever in the force multiplying system and the pivotal interface between cut-in lever 70 and the range lever 68 of such patent to improve stability by eliminating the split in the stabilizing lost member 74 of such patent and reduce cost.

The range lever 24 and driving lever 30 provide the following functions:

(1) to drive the toggle and snap action switch mechanism; and (2) to provide both "cut-in" adjustment and "cut-out" adjustment.

Figure 8:
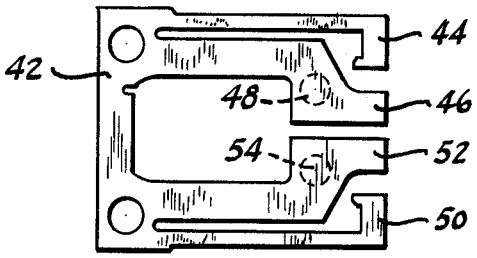
FIG. 8 is a top plan view of the reed showing a pair of split legs embodying an essential part of this invention.

Another essential feature of this invention is the provision of a reed 42 (see FIG. 8) which differs from the reed 54 of such patent reed 42 has a pair of split legs one leg 44 of one pair is a flipper leg and functions to provide spring force to another leg 46 of such one pair which carries a contact 48 made of alloy material such as tungsten or copper alloy which is very resistant to erosion and welding due to arcing. One leg 50 of the other pair is also a flipper leg which provides spring force to a contact carrying leg 52. The leg 52 carries a silver contact 54 which is capable of conducting current in excess of 20 amp. at 250 V.

Figure 9:
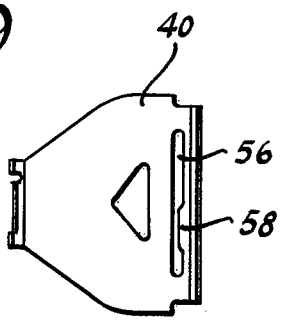
FIG. 9 is an end view of a flipper spring having a lost motion slot embodying the essence of this invention.

A flipper spring 40 has a lost motion slot 56 (see FIG. 9). This slot has raised portion 58 so that when the reed 42 is assembled to the flipper spring 40, such raised portion engages the flipper leg 52 to drive and maintain the silver contact 54 into engagement with a fixed contact and thence to be in current carrying connection whenever the control calls for energy transfer. However, the other wider portion of slot 56 provides greater lost motion to permit the leg 46 with the arc resisting contact 48 to make and break the energy carrying circuit. Thus, the silver contact 54 only makes and breaks contact under very low to no current and negligible arcing conditions since immediately upon opening of this contact, there is instantaneous transfer of the entire load to the other reed leg with its arc resistant contact 48 which contact will be maintained in closed position in contact with a fixed contact. It is not until further motion of the flipper spring 40 of the toggle mechanism 38 takes place that the control will then cause the arc resisting contact 48 to break or make the circuit.

I claim:

1. A thermostatic control having a calibrated thermal responsive power element, a toggle and snap switch mechanism operated by said element, a drive lever engaged with said mechanism, an adjustable range lever associated with said lever, and a flexible leaf member to connect said range lever to said drive lever; said control characterized in that said range and drive levers are the only force multiplying transmission means between said power element and said toggle and snap switch mechanism.

2. A control as defined in claim 1 in which there is a reed operably associated with said mechanism, said reed, having two contacts thereon, one such contact being resistant to erosion by arcing and welding and the other contact capable of carrying control operating current, said contacts being separately movable and sequentially controlled to cooperate with fixed contacts.

3. A control as defined in claim 2 in which there is lost motion means comprising a slot in a flapper spring cooperating with said reed, said slot acting to sequentially open first and close last the current carrying contact while permitting said arc resistant contact to make and break circuit carrying current means.

4. A control as defined in claim 3 in which the first contact is of high arc resistant alloy such as tungsten silver and said second contact is of efficient current transmission material such as silver adapted to carry current in excess of 20 amps. at 250 V.

* * * * *